US006912877B2

(12) United States Patent
Yokoyama et al.

(10) Patent No.: US 6,912,877 B2
(45) Date of Patent: Jul. 5, 2005

(54) STRETCH FABRIC

(75) Inventors: Kenichi Yokoyama, 15-4, Motoyokoyama-cho 3-chome, Hachioji-shi, Tokyo (JP); Genkichi Yokoyama, Hachioji (JP); Goro Aoki, Saitama (JP)

(73) Assignee: Kenichi Yokoyama, Hachioji (JP)

( * ) Notice: Subject to any disclaimer, the term of this patent is extended or adjusted under 35 U.S.C. 154(b) by 50 days.

(21) Appl. No.: 10/004,771

(22) Filed: Dec. 4, 2001

(65) Prior Publication Data

US 2002/0115369 A1 Aug. 22, 2002

(30) Foreign Application Priority Data

Dec. 5, 2000 (JP) ..... 2000-370313
Jun. 4, 2001 (JP) ..... 2001-168628

(51) Int. Cl.[7] ..... D04B 21/00
(52) U.S. Cl. ..... 66/195
(58) Field of Search ..... 66/192, 195, 196, 66/202, 193, 169 R, 170, 171; 442/304, 306, 308, 312, 318; 602/3, 1, 44

(56) References Cited

U.S. PATENT DOCUMENTS

| | | | | |
|---|---|---|---|---|
| 4,667,661 A | | 5/1987 | Scholz et al. | |
| 4,668,563 A | | 5/1987 | Buese et al. | |
| 4,683,877 A | | 8/1987 | Ersfeld et al. | |
| 4,893,617 A | | 1/1990 | Bartial et al. | |
| 4,984,566 A | | 1/1991 | Sekine et al. | |
| 5,042,464 A | | 8/1991 | Skwor et al. | |
| 5,256,134 A | * | 10/1993 | Ingham | 602/8 |
| 5,353,486 A | * | 10/1994 | Schmidt et al. | 28/167 |
| 5,461,885 A | * | 10/1995 | Yokoyama et al. | 66/170 |
| 5,638,703 A | * | 6/1997 | Callaway | 66/195 |
| 5,855,124 A | * | 1/1999 | Donaghy et al. | 66/195 |
| 6,223,782 B1 | * | 5/2001 | Watkins | 139/383 R |

FOREIGN PATENT DOCUMENTS

| | | | |
|---|---|---|---|
| CN | 1148799 A | 4/1997 | |
| JP | 62-82957 | 4/1987 | |
| JP | 62-87162 | 4/1987 | |
| JP | 63-11165 | 1/1988 | |
| JP | 2-71746 | 3/1990 | |
| JP | 03-038384 | 4/1991 | D04B/21/14 |
| JP | 06277249 A | 10/1994 | A61F/13/04 |
| JP | 7-197356 | 8/1995 | |
| JP | 08308871 A | 11/1996 | A61F/13/12 |
| JP | 09137380 A | 5/1997 | D06M/15/00 |
| WO | WO 95/26698 | 10/1995 | |

OTHER PUBLICATIONS

D. F. Paling, F.T.I., Warp Knitting Technology, 1970, pp. 324–332.

"Knitting Technology" (Third volume; Warp Knitting), pp. 327 to 239 (Chinese language literature). Jun. 1986 (with translation).

* cited by examiner

*Primary Examiner*—Danny Worrell
(74) *Attorney, Agent, or Firm*—Schnader Harrison Segal & Lewis LLP

(57) ABSTRACT

A stretch fabric material having an elongation of at least 20% in the warp direction is provided with both of the stretchability and the stiffness, which is composed of a Raschel warp knit fabric formed of non-stretchable fiber yarns having no rubbery elasticity, wherein loops of tuck warp are engaged with loops of a ground fabric structure. Since the stretch knit fabric material of the invention exhibits a gentle tightening force when covering or bandaging a human body, it is suitably used for a medical material for covering or bandaging a human body having curved or irregular portions, a reinforcement material for a molded object having curved or irregular figure or portions, a stretchable bandage, a casting tape or a splint for orthopedic surgery use.

16 Claims, 5 Drawing Sheets

STRETCH FABRIC

BACKGROUND OF THE INVENTION

1. Field of the Invention

The present invention relates to a stretch fabric composed of a Raschel warp knit fabric, particularly to a stretch fabric suitably used as a medical material for covering or bandaging a curved or irregularly-shaped object or a portion of a human body, or as a reinforcement for a molded object having a curved or irregular surface, and to the use thereof.

2. Description of the Related Art

It has been well-known to use a glass fiber cloth as a fiber reinforcement for a molded plastic figure such as orthopedic cast. When orthopedic cast is manufactured, a warp knit fabric substrate of glass fiber yarns in which inlaid yarns are inlaid into a ground fabric structure of a chain stitch or others by using a warp knitting machine with a plurality of guide bars such as a Raschel warp knitting machine is often used as a casting tape. Generally, a mold for orthopedic surgery plastic cast is a human body having irregular and curved surfaces, and it has been also known that a stretchable knit fabric is used in the preparation of the orthopedic cast for imparting the irregular or curved surfaces with a elastically recovering properties as seen in a casting tape or a substrate for orthopedic cast (see Japanese Unexamined Patent Publication No. 62-82957; U.S. counterpart, U.S. Pat. Nos. 4,683,877, 4,893,617, 5,042,464). As disclosed in Japanese Unexamined Patent Publication No. 62-87162 (U.S. counterpart, U.S. Pat. No. 4,667,661), the casting tape for the orthopedic surgery is used while being coated with a water-curable non-adhesive resin composed of a resin such as polyurethane and containing wetting agent.

When the orthopedic cast is prepared it has been known to use a casting tape of a stretchable Raschel warp knit fabric incorporating elastomeric fibers or crimpt yarns of synthetic fibers such as polyester fibers, into the knit structure to be fit to the irregular surface of the affected part such as bone fracture, dislocation, distortion or others (see, for example, Japanese Unexamined Patent Publication No. 63-11165 (U.S. counterpart; U.S. Pat. No. 4,668,563) and Japanese Unexamined Patent Publication No. 2-71746 (U.S. counterpart; U.S. Pat. No. 4,984,566). The fiber reinforcement stretch fabric substrate such as the stretchable casting tape formed of stretchable fiber material, however, is expensive in material cost as well as problematic in functions as described below.

The fabric is liable to bind tight the affected part to interrupt the blood circulation while the resin impregnating the fabric when the orthopedic cast is manufactured is curing, since a large stretch-back property of the elastomeric polyurethane fiber is applied to the stretch fabric substrate containing the same, and also there are problems in the moldability or handling of the gypsum in that the polyurethane elastomeric fiber may become brittle due to the reaction with the resinous component or the gypsum may be difficult to be cut after being cured. On the other hand, also in a Raschel warp knit fabric substrate in which the textured yarns of synthetic fiber are used, there is a problem in that a casting tape having a favorable stiffness required for the moldability and fiber-reinforcement function of the gypsum is difficult to obtain.

The knitting of a warp knit fabric by using a Raschel warp knitting machine with a fall-plate has been known as a method for providing a tuck pattern of thick yarns to a warp knit fabric and a method for knitting a fabric in which wales of chain stitches of tuck warp are coupled to each other so that part of the ground fabric structure is allocated to the tuck warp (See "Warp Knitting Technology", pages 325 to 332, by D. F. Paling; FTI: Columbine Press, 1970). The known method in which the fall-plate is adopted has been used for knitting a Raschel knit fabric having a pattern of loops caused by the fall-plate.

BRIEF DESCRIPTION OF THE DRAWINGS

FIG. 4 illustrates a schematic view of one example of a Raschel double-sided knit fabric and a sectional structure thereof wherein

Figure 1:
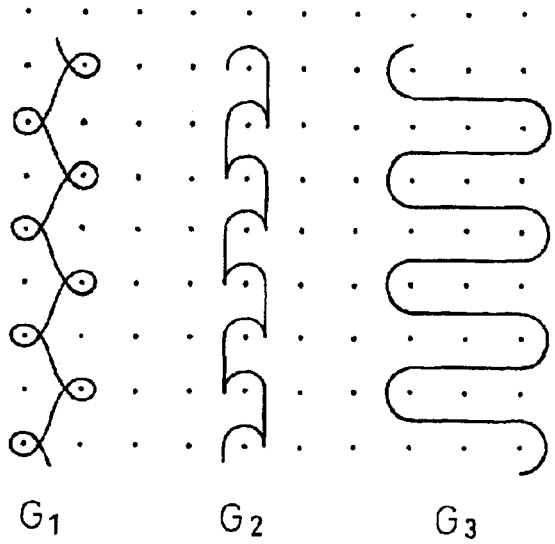
FIG. 1 illustrates lapping movements for a knit fabric forming a stretch fabric material obtained by Examples 1, 2, 3 and 6 according to the present invention.

In the drawings, G represents a guide bar; F a front guide bar lapping movement; B a back guide bar lapping movement; 1 a tuck warp; 2 a warp for a ground stitch (a chain stitch); 3, 3*a*, 3*b*, 3*c*, 3*d* and 3' a tuck loop; 20 a double-sided knit fabric; 21 and 22 a ground fabric of the double-sided knit fabric, respectively; 100 a device for measuring an elongation; 101 a test piece; 102 a machine base table; 104 an upper clamp; 105 an aluminum pipe; 106 a ruler; 107 a weight; and A–A' a sectional line.

DISCLOSURE OF THE INVENTION

An object of the present invention is to provide a medical material capable of covering or bandaging a curved or irregular part of an irregularly-shaped object such as a human body at an appropriate tension, a stretch fabric material composed of a Raschel warp knit fabric suitable for a fiber-reinforcement of a molded product having curved or irregular part, and uses thereof. Another object of the present invention is to provide a Raschel warp knit fabric having both stretchability and stiffness suitable for the above-mentioned uses without using elastomeric fibers or textured fibers.

SUMMARY OF THE INVENTION

The present invention is a stretch fabric material composed of a Raschel warp knit fabric formed of substantially non-stretchable fiber yarns, in which loops of tuck warp are engaged with loops of a ground fabric structure, wherein the fabric has an elongation of at least 20% in the warp direction.

Figure 5A:
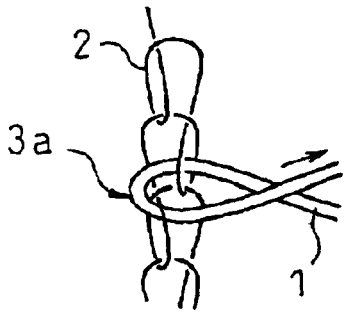
FIG. 5 illustrates examples of a tuck warp loop engaged with cotton laps of a chain stitch forming a ground knit fabric structure.
Figure 5B:
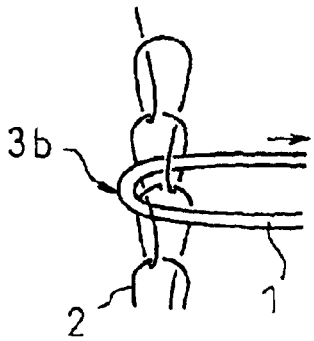
Figure 5C:
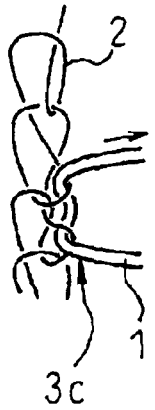
Figure 5D:
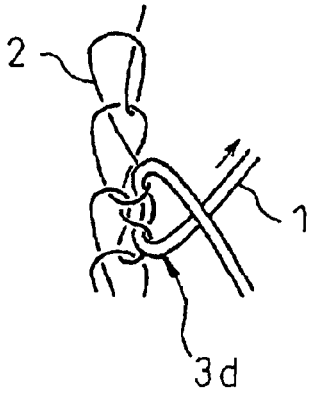

The loop of tuck warp referred to in the present invention is a loop formed of a warp yarn separate from that forming a loop of the ground fabric structure, which tuck warp is additionally transferred to the back side of the stitches to be additionally engaged with the back side of the loops of the ground fabric structure so that it does not cause any restraint on the lap of the ground fabric. FIG. 5 illustrates several examples of a knit stitch in which a cotton lap of a chain stitch loop (2) forming a ground fabric structure is engaged with a tuck warp loop (3). FIG. 5(A) shows the engagement (3*a*) of the chain stitch (2) of the ground fabric with a silk lap (close lap) in the opposite direction to the lapping direction; FIG. 5(B) shows the engagement (3*b*) of the chain stitch (2) of the ground fabric with a cotton lap (open lap) in the same direction as the lapping direction; FIG. 5(C) shows the engagement (3*c*) of the chain stitch (2) of the ground fabric with a silk lap in the same direction as the lapping direction; and FIG. 5(D) shows the engagement (3*d*) of the chain stitch (2) of the ground fabric with a cotton lap in the opposite direction to the lapping direction.

While the loop of the tuck warp is typically formed by a Raschel warp knitting machine with a fall-plate, it may be formed by using a guide bar, a knitting needle, a tongue of a pipe needle, a trick plate or others in place of the fall-plate, by imparting each of them with a special movement in accordance with a method for forming a floating pattern by using a composite needle as disclosed in Japanese Unexamined Patent Publication No. 07-197356.

As described above, according to the present invention, it is possible to obtain a stretch fabric material excellent in resiliency (having a repulsive elasticity) formed of a Raschel warp knit fabric which is substantially composed of ordinary yarns by adopting a knitting structure in which a loop of tuck warp is engaged with loops of a ground fabric structure.

Figure 7:
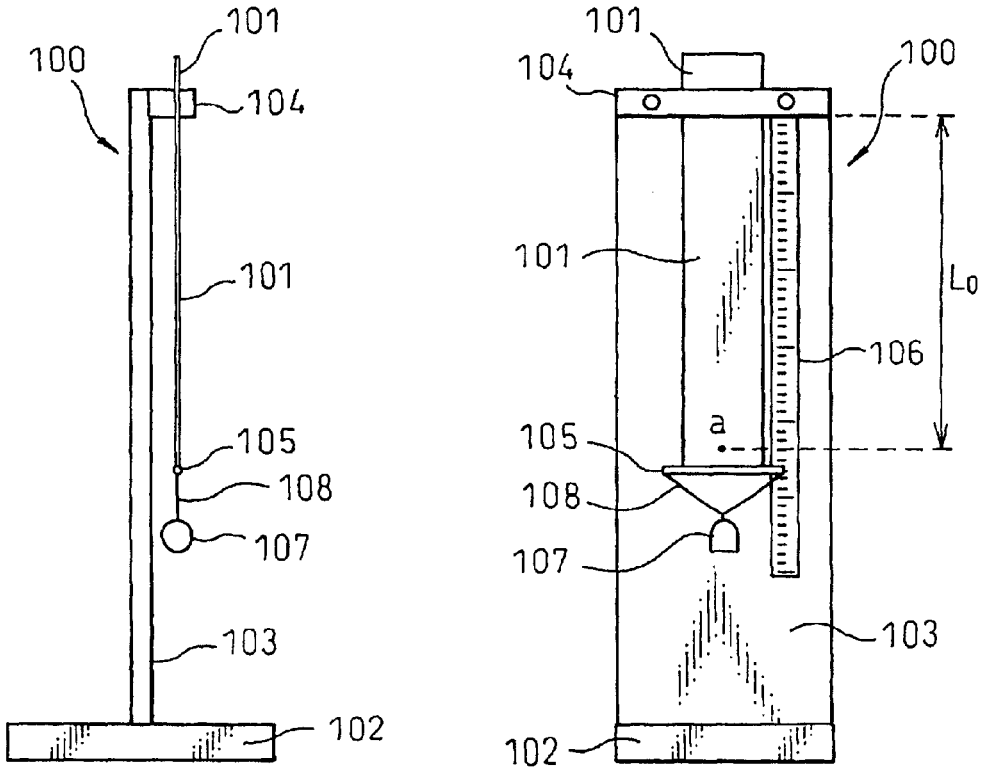
FIG. 7 illustrates a conceptual view of a device for measuring an elongation of a stretch fabric material.

An elongation referred to in the present invention is measured by using an elongation measurement device 100, shown in FIG. 7, wherein a test piece of a rectangular shape of 25 cm long in the warp direction (course direction) and 10 cm wide vertical thereto is prepared from a knit fabric. The test piece is suspended while being widthwisely gripped at the upper end thereof with an upper clamp 104, and a value is calculated from the following equation (1) based on a measured length $L_0$ of the test piece under an initial load of 5 g and that $L_1$ under an increased load of 300 g. The measurement is repeated on five samples of a selected one kind of a knit fabric and the respective values are averaged to be the elongation:

$$\text{Elongation } (\%)=[(L_1-L_0)/L_0]\times 100 \quad (1)$$

In this regard, the knit fabric may be either a grey fabric, a scoured fabric or a heat-cleaned or heat-set fabric.

The measurement is carried out by using the device shown in FIG. 7 as follows. The test piece 101 is suspended while being gripped at the longitudinal upper end thereof so that a load is applied to the test piece uniformly in the widthwise direction with an upper clamp 104 fixed to a top of a flat plate 103 straightly standing up on a base table 102. On the other hand, an aluminum pipe 105 having a length sufficiently traversing the width of the test piece is sewn to the lower end of the suspended test piece in advance, and a loop 108 is provided through a pipe bore for hooking a weight 107 of 300 g. The aluminum pipe 105 or others added to the test piece is adjusted in advance to impart the test piece with the initial load of 5 g. 30 minutes after the test piece has been gripped by the upper clamp and suspended therefrom, a point (a) on the test piece apart 20 cm from the lower edge of the upper clamp is marked, and defined as an original length of the test piece $L_0$ in comparison with a ruler 106 fixed on a front surface of the flat plate. Next, the weight 107 is hooked to the loop 108, and after being stationary for 30 minutes, a position of the marked point is read to have an elongated length $L_1$ of the test piece.

CONCRETE ASPECTS OF THE INVENTION

Fiber material for forming the inventive stretch fabric is inorganic or organic artificial fibers essentially having no rubbery elasticity (such fibers may hereinafter be referred to as ordinary yarns or hard fiber yarns). In the present invention, stretchable fibers such as spandex fiber (elastomeric fiber) having rubbery elasticity or textured yarns of synthetic or chemical fibers are basically not used. The inorganic fiber used in the present invention typically includes glass fiber now on the market. Of course, steel fiber and alumina fiber now on the market may be included. The organic fiber includes natural fibers such as cotton or ramie; chemical fibers such as rayon fiber or acetate fiber; synthetic fibers such as polyamide fiber, polyester fiber, polyolefin fiber such as polypropylene fiber, acrylic type fiber or heat-resistant and high-modulus fiber such as aramid fiber or polyimide fiber, all of which are ordinary yarns (not being textured to have crimps or the like for the purpose of obtaining the stretchability). Such fibers may be used either in a form of monofilamentary yarn, multifilamentary yarn or spun yarn. A certain amount of textured yarn may be partially incorporated in the inventive stretchable knit fabric for the purpose of further facilitating the stretchability by the combination of a unique stretching property of the knit structure including loops of tuck warp with the characteristic of the fiber itself, while improving the softness of the resultant fabric.

The stretchability of the stretch fabric of the invention may be designed in various manner by the selection of fiber size and properties of the yarn used as tuck warp. In the design in which glass fiber yarns are used for forming a structure of the fabric, it is advantageous to suitably mix synthetic yarns into the fabric structure formed of the glass fiber yarns so that a hot-melt edge is provided in the knit fabric to prevent a cut end edge of the knit fabric from being frayed. Glass fiber yarns and synthetic monofilamentary yarns are suitably used as tuck warp for obtaining a stretchable knit fabric excellent in resiliency. If the synthetic monofilamentary yarns having a size of at least 55.6 dtex are used as tuck warp, it is possible, although it depends on a modulus inherent to the synthetic fiber, to obtain a stretch fabric excellent in resiliency, having high stretchability and elastic recovery of elongation, which is suitable for producing a casting tape at a low cost, which tape is easily layable even when coated with high-viscosity resin. Also, it is possible to obtain a relatively thin fabric exhibiting a significant stretchability solely from polyester fibers without using thick yarns, if multifilamentary yarns are arranged in a ground fabric structure and monofilamentary yarns which is less in creep deformation are arranged in tuck warp. Such a thin stretch fabric excellent in stretchability is suitable for a casting material to be coated with high-viscosity resin of approximately 10000 cps or more for the purpose of enhancing the laying ability while suppressing the fluidity of the coated resin. Also, this fabric is useful for a material of a soft and elastic bandage and supporter for wrapping a human body.

Generally, a size of yarn forming the stretch fabric of the invention is generally selected from a range from 55.0 to 1100 dtex while taking physical properties such as resiliency, softness stretchability or others of the yarn into account. In general, the yarn may be either multifilamentary one or monofilamentary one. If the multifilamentary yarn is used, it is usually composed of a plurality of single-filaments of approximately 2 dtex or more. In view of a softness of the resultant knit fabric, use of multifilamentary is preferred. If the monofilamentary yarn is used, it has a size in a range from 16.0 dtex to 777.8 dtex, preferably from 55.0 to 555.6 dtex, more preferably from 77.8 to 333.3 dtex. When a plied yarn formed by plying a plurality of the above-mentioned yarns is used, it is possible to adjust a resiliency and/or basis weight of the resultant knit fabric. If a synthetic monofilamentary yarn is used as tuck warp, softness or hand of the resultant bandage can be improved by using the monofilamentary yarn in a composite form containing other fibers to be a core yarn, a covered yarn, a folded or piled yarn, or multi-fold twistless yarn.

The stretch fabric of the invention is preferably knit in such a manner that suitably selected ordinary yarns are threaded to a guide bar for knitting a ground fabric structure which is generally of a chain stitch or a dembigh-stitch, and yarns such as glass fiber yarns having a relatively high modulus are threaded to the guide bar of tuck warp, wherein the tuck warp yarn is overlapped with the knitting needle forming a needle loop of the ground fabric structure and knocked over by the action of the fall-plate or a special movement imparted by the guide bar, a needle, a tongue of a pipe needle or a trick plate, together with old loops of the ground fabric structure being knit so that the tuck warp does not engage the hook of the needle.

According to the knitting of the fabric of the invention, the tuck loop of warp different from that forming the ground fabric structure is additionally transferred to the needle and, prior to lowering the needles, pushed down from a latch of the needle, for example, by the action of the fall-plate, after which the pushed-out lap (or a fall-plate lap if the fall-plate is used) is knocked over together with the old loop of the ground fabric structure to be additionally knit into the back side of the ground fabric structure. The tuck warp thus additionally knit does not restrain the lap of the ground fabric structure, but a sinker loop thereof appears on the back side in a floating manner and is engaged with the laps of the ground fabric structure solely at a position transferring to the needle by the overlap at right and left ends, thereby a Raschel knit fabric having a knitted structure exhibiting elastic property being formed.

According to the present invention, any kind of ground fabric structure may be used. While a chain stitch is generally preferably used in view of its simplicity, a dembigh-stitch forming a soft ground fabric structure or a queen's cord stitch enhancing the course-directional strength may be adopted in accordance with purposes thereof. It is possible to obtain a knit fabric mechanically stable in shape by incorporating inlaid yarns into a ground knit fabric of the Raschel warp knit fabric to such an extent that the stretchability of the knit fabric containing tuck loops of tuck warp is not lowered. The ground fabric structure is usually knit while the guide bar is in a full-set state. By adopting a knit structure in which a tuck loop of tuck warp is engaged with a loop of the ground fabric structure, a fiber-reinforced fabric suitable for a casting tape, having a basis of weight in a range from 100 to 500 g/m$^2$ and an elongation of 20% or more, preferably 30% or more, in some cases exceeding 50%, required for a casting tape is easily obtainable.

According to the present invention, since such a yarn having a good elastic recovery is incorporated into a knit structure as a tuck warp loop, the resultant fabric exhibits stretchability. That is, when the fabric is stretched by the deformation of the tuck loop of tuck warp in the knit structure forming the fabric, the stretch-back property is easily exhibited. As can be understood from a knitting stitch shown in FIG. 2 which is a three-dimensional view of a fabric obtained from Example 4 of the present invention, since the tuck warp is knit into a easily movable structure in which the tuck warp loosely wraps an engaging portion of a sinker loop with a needle loop of the ground fabric structure such as a chain stitch (plain stitch), a dembigh stitch or a queen's cord stitch, the knit fabric exhibits the elastic recovery of elongation when the stretched tuck warp shrinks to the original tuck loop. The elastic recovery of elongation of the knit fabric obtained by this action is adjustable by selecting kinds of yarns used as tuck warp and sizes of fibers forming yarns of tuck warp. If yarns hardly causing creep deformation are used as tuck warp, such as glass fiber yarns or polyester fiber yarns, it is possible to obtain a fabric excellent in elastic recovery of elongation and in resiliency.

The yarns forming the tuck warp loop are threaded to the guide bar preferably in a full-set state on account of the stretchability although other threading manners may be adopted, such as every second eye empty (1 in, 1 out and repeat), every second and third eye empty (1 in, 2 out and repeat) or every second, third and fourth eye empty (1 in, 3 out and repeat). The knitting operation is carried out by the lapping movement similar to that of silk lap or cotton lap dembigh or queen's cord stitch (in some cases, a chain stitch). The stretchability of the fabric is adjustable by changing the selection and/or combination of the lapping movements.

A grey fabric of the Raschel warp knit fabric knit as described above may be used as it is as a reinforcement fabric material. However, when it is necessary to remove the sizing agent or finish oil from the yarns prior to being used as a reinforcement fabric material, the grey fabric may be heat-cleaned or scoured and thereafter used as a reinforcement fabric material.

When the reinforcement knit fabric material of the invention is a Raschel warp knit fabric containing thermoplastic fiber yarns, the knit fabric is preferably used after being heat-set on account of stabilizing a shape of the knit fabric and enhancing the stretchability. The knit fabric may be knit to have either a tape width or a broad width.

Figure 4A:
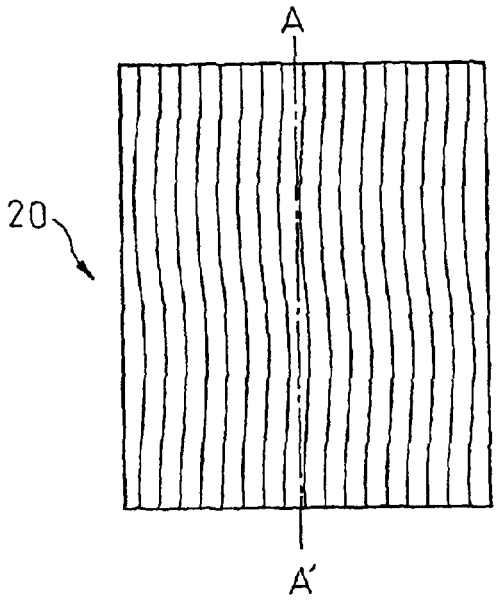
FIG. 4(A) is a plan view of the knit fabric and FIG. 4(B) is a cross-sectional view thereof.
Figure 4B:
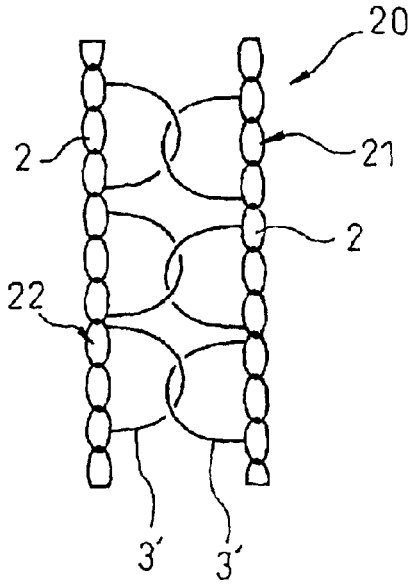

The stretch fabric material of the invention may be a double-sided knit fabric obtained by a double needle bed type Raschel warp knitting machine. One example of the double-sided Raschel warp knit fabric containing tuck warp loops knit by the double needle bed type Raschel warp knitting machine provided with a fall-plate is shown in FIG. 4. FIG. 4(B) schematically illustrates the double-sided Raschel warp knit fabric 20 in a shape as if it is composed of a pair of ground knit fabrics 21, 22 by a single Raschel warp knitting machine, respectively, which are overlapped each other so that the back surfaces are in contact with each other and connected each other by tuck loops 3' of tuck warp. Since this double-sided warp knit fabric is of a somewhat hollow structure having a sufficient thickness, it has enough strength for being used as it is as a fiber-reinforcement fabric material exhibiting a favorable elastic stretchability, and is suitably used as a splint for orthopedic surgery.

The stretch fabric material of the invention may be a tape having a width in a range from 5 to 20 cm or, in some cases, reaching several tens cm, to which is impregnated or coated synthetic resinous composition normally used for the casting, whereby an inexpensive stretchable casting tape of splint excellent in modeling property is provided. Since a reinforced plastic molded product can be easily produced in conformity with a required complicated configuration from the stretch fabric of the invention without using an expensive mold, by only treating a plaster mold or an actual object with a mold release agent, the stretch fabric of the invention is very convenient for multi-kind/small-lot production.

It was confirmed that the stretch fabric of the invention is favorably used for a medical fabric material for covering part of a human body, such as stretch bandage or gauze because of its gentle tightening force.

BEST MODE FOR CARRYING OUT THE INVENTION

The concept of the present invention will be more concretely described with reference to the preferred embodiments of a stretch fabric produced by using a Raschel warp knitting machine with a fall-plate.

In this regard, the elastic recovery of elongation referred to in Examples or Comparative examples is an estimated value of a stretch-back property of the knit fabric calculated by the following equation:

$$\text{Elastic recovery of elongation } (\%)=[(L_1-L)/(L_1-L_0)]\times 100 \quad (2)$$

wherein L represents a length of the test piece 30 minutes after releasing the tensile load of 300 g therefrom in the measurement of the elongation.

Figure 6:
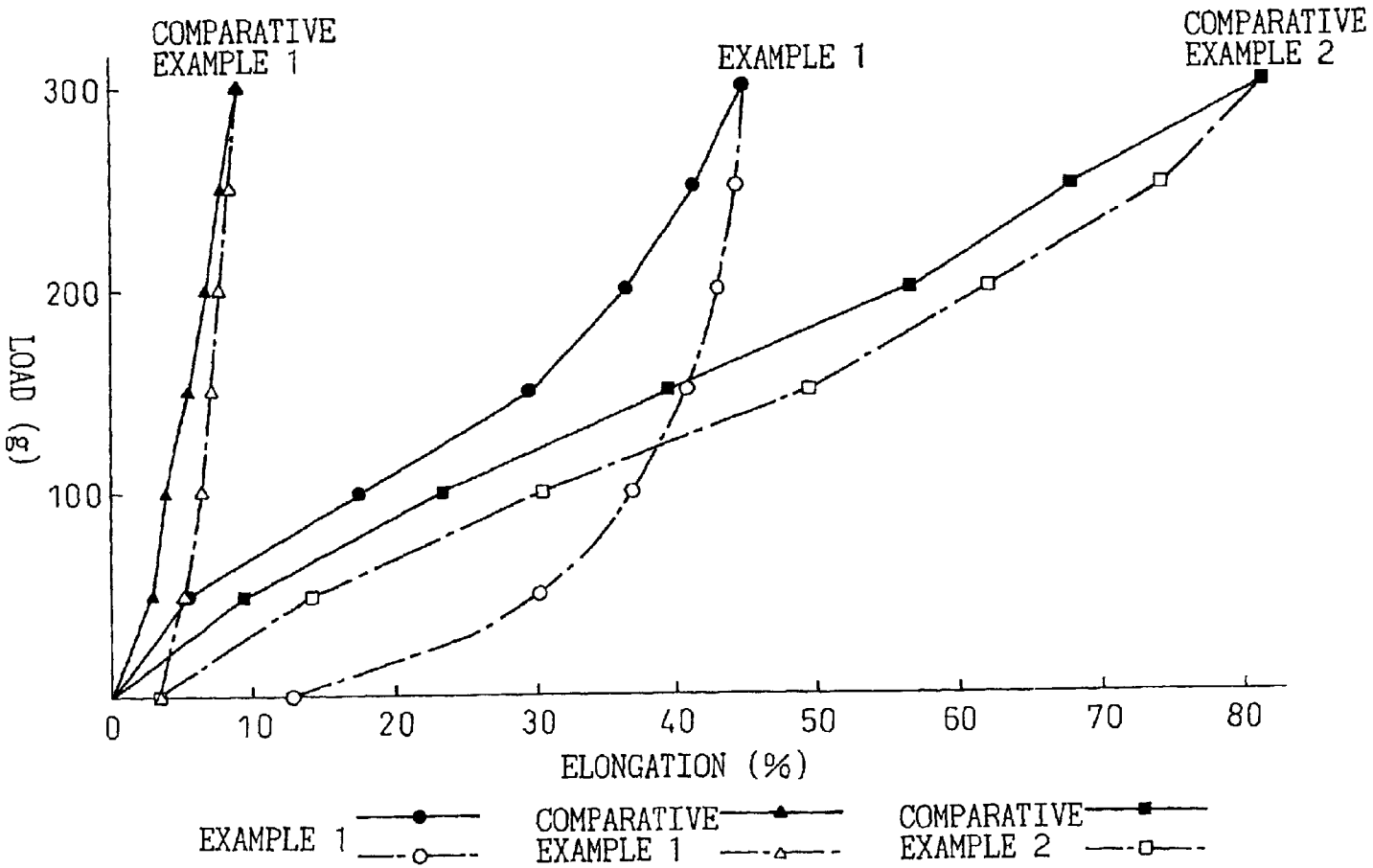
FIG. 6 illustrates graphs of a tensile elongation under load of fabrics obtained by Example 1, Comparative examples 1 and 2, respectively, during the stretching and shrinking cycle.

The tensile elongation and returning elongation of the fabrics obtained from a certain Example and Comparative examples 1 and 2 are shown in FIG. 6, which data are calculated from the elongation of the test piece in accordance with the equation (1) while stepwisely changing the load of 300 g used for the measurement of the elongation.

EXAMPLE 1

A Raschel warp knit fabric was knit from glass fiber yarns (hereinafter referred merely to as GF) of 669 dtex/400 f by using a single Raschel warp knitting machine (9 gauge) having three guide bars ($G_1$, $G_2$ and $G_3$) with a fall-plate under the following knitting conditions. The lapping movements of the guide bars in the knitting operation are shown in FIG. 1.

| Guide bars | Threading | Chain link | Yarn/Number of ends threaded |
|---|---|---|---|
| $G_1$ (front guide bar for tuck warp in front of fall-plate) | full-set | 12/10 | GF/1 |
| $G_2$ (middle guide bar for ground fabric structure) | full-set | 10/01 | GF/1 |
| $G_3$ (back guide bar for inlaid yarn) | full-set | 00/33 | GF/1 |

The resultant grey fabric was finished by soaping at 70° C. for 30 minutes in a bath containing enzymatic desizing agent at 15 g per one litre of water. The physical properties of the finished fabric are as follows:

Basis of weight: 456 g/m$^2$

Course density: 16.5 courses/2.54 cm

Wale density: 12.5 wales/2.54 cm

Elongation: 44.8%

Elastic recovery of elongation: 71.9%

EXAMPLE 2

A Raschel warp knit fabric was knit from glass fiber yarns GF of 669 dtex/400 f and polyester fiber yarns (hereinafter referred merely to as P) of 275 dtex/24 f by using a single Raschel warp knitting machine (9 gauge) having three guide bars ($G_1$, $G_2$ and $G_3$) with a fall-plate under the following knitting conditions. The lapping movements of the guide bars during the knitting operation are shown in FIG. 1.

| Guide bars | Threading | Chain link | Yarn/Number of ends threaded |
|---|---|---|---|
| $G_1$ (front guide bar for tuck warp in front of fall-plate) | full-set | 12/10 | GF/1 |
| $G_2$ (middle guide bar for ground fabric structure) | full-set | 10/01 | P/1 |
| $G_3$ (back guide bar for inlaid yarn) | full-set | 00/33 | P/2 |

The resultant grey fabric was finished by a soaping in a bath containing enzymatic desizing agent at 15 g per one litre of water. The physical properties of the finished fabric are as follows:

Basis of weight: 404 g/m$^2$

Course density: 15.5 courses/2.54 cm

Wale density: 12 wales/2.54 cm

Elongation: 40.6%

Elastic recovery of elongation: 75.1%

EXAMPLE 3

A Raschel warp knit fabric was knit from polyester fiber yarns P of 275 dtex/24 f by using a single Raschel warp knitting machine (9 gauge) having three guide bars ($G_1$, $G_2$ and $G_3$) with a fall-plate under the following knitting conditions. The lapping movements of the guide bars during the knitting operation are shown in FIG. 1.

| Guide bars | Threading | Chain link | Yarn/Number of ends threaded |
|---|---|---|---|
| $G_1$ (front guide bar for tuck warp in front of fall-plate) | full-set | 12/10 | P/4 |
| $G_2$ (middle guide bar for ground structure) | full-set | 10/01 | P/1 |
| $G_3$ (back guide bar for inlaid yarn) | full-set | 00/33 | P/2 |

The resultant grey fabric was finished by a soaping in a bath containing synthetic detergent at 50° C. for 30 minutes. The physical properties of the finished fabric are as follows:

Basis of weight: 415 g/m$^2$

Course density: 18 courses/2.54 cm

Wale density: 9.5 wales/2.54 cm

Elongation: 54.3%

Elastic recovery of elongation: 69.6%

EXAMPLE 4

Figure 2:
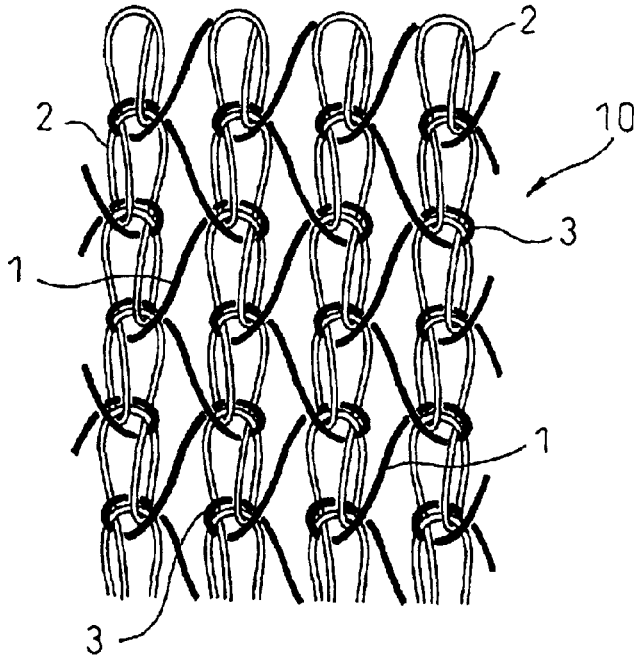
FIG. 2 illustrates a three-dimensional view of warp knit stitches of a knit fabric forming a stretch fabric material obtained by Example 4 according to the present invention.

A Raschel warp knit fabric was knit from polyester fiber yarns P of 275 dtex/24 f by using a single Raschel warp knitting machine (9 gauge) having two guide bars ($G_1$ and $G_2$) with a fall-plate under the following knitting conditions. The three-dimensional knit structure is shown in FIG. 2

| Guide bars | Threading | Chain link | Yarn/Number of ends threaded |
|---|---|---|---|
| $G_1$ (front guide bar for tuck warp in front of fall-plate) | full-set | 12/10 | P/4 |
| $G_2$ (back guide bar for chain stitch) | full-set | 10/01 | P/2 |

The resultant grey fabric was finished by a soaping in a bath containing synthetic detergent at 50° C. for 30 minutes. The physical properties of the finished fabric are as follows:

Basis of weight: 341 g/m$^2$

Course density: 16 courses/2.54 cm

Wale density: 9 wales/2.54 cm

Elongation: 40.8%

Elastic recovery of elongation: 68.1%

EXAMPLE 5

Figure 3:
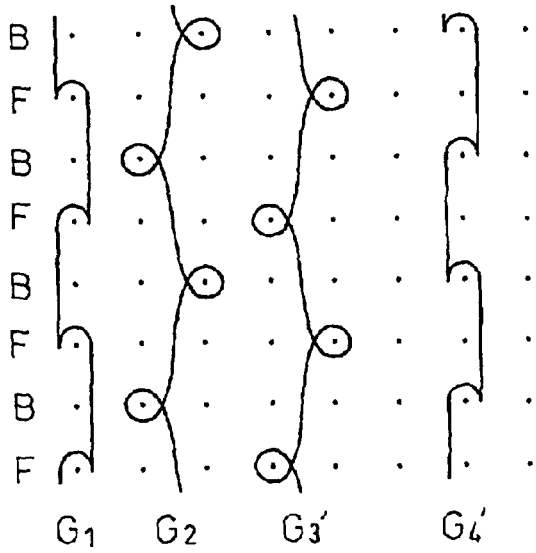
FIG. 3 illustrates lapping movements for a double-sided knit fabric forming a stretch fabric material obtained by Example 5 using a double-needle bed type Raschel warp knitting machine according to the present invention.

A Raschel warp knit fabric was knit from polyester fiber yarns P of 275 dtex/24 f by using a double Raschel warp knitting machine (9 gauge) having four guide bars ($G_1$, $G_2$, $G_3$ and $G_4$) with a single fall-plate under the following knitting conditions. The lapping movements of the guide bars during the knitting operation are shown in FIG. 3.

| Guide bars | Threading | Chain link | Yarn/Number of ends threaded |
|---|---|---|---|
| $G_1$ (1 front guide bar for chain stitch) | full-set | 10/00//01/11 | P/2 |
| $G_2$ (1 back guide bar for fall-plate) | full-set | 11/12//11/10 | P/4 |
| $G_3$ (2 front guide bar for fall-plate) | full-set | 12/11//10/11 | P/4 |
| $G_4$ (2 back guide bar for chain stitch) | full-set | 11/10//00/01 | P/2 |

The resultant grey fabric was finished by soaping in a bath containing synthetic detergent at 50° C. for 30 minutes. The physical properties of the finished fabric are as follows:

Basis of weight: 746 g/m$^2$

Course density: 17 courses/2.54 cm

Wale density: 9.5 wales/2.54 cm

Elongation: 31%

Elastic recovery of elongation: 72.6%

EXAMPLE 6

A Raschel warp knit fabric was knit by using a single Raschel warp knitting machine (9 gauge) having three guide bars ($G_1$, G2 and $G_3$) with a fall-plate under the following knitting conditions. The lapping movements of the guide bars during the knitting operation are shown in FIG. 1.

| Guide bars | Threading | Chain link | Yarn/Number of ends threaded |
|---|---|---|---|
| $G_1$ (front guide bar for tuck warp in front of fall-plate) | full-set | 12/10 | P-monofilament (222.2 dtex)/1 |

-continued

| Guide bars | Threading | Chain link | Yarn/Number of ends threaded |
|---|---|---|---|
| $G_2$ (middle guide bar for ground structure) | full-set | 10/01 | P-multi-filamentary yarn (277.8 dtex/24f)/2 |
| $G_3$ (back guide bar for inlaid yarn) | full-set | 00/33 | P-multi-filamentary yarn (166.7 dtex/48f)/1 |

The resultant grey fabric was heat-treated by boiling water at 100° C. at a tension of 20 g/10 cm width for about 5 seconds, dehydrated and dried. The physical properties of the finished fabric are as follows:

Course of density: 22 courses/2.54 cm

Wale density: 11.4 wales/2.54 cm

Finished width: 100 mm

Basis weight: 265 g/m$^2$

Elongation: 52%

Elastic recovery of elongation: 86.0%

Comparative Example 1

A Raschel warp knit fabric of 10 cm wide composed of a chain stitch and an inlaid structure most generally used for a casting tape was knit from glass fiber yarns (GF of 669 dtex/400 f) by using a single Raschel warp knitting machine (12 gauge) having two guide bars ($G_1$ and $G_2$) under the following knitting conditions.

| Guide bars | Threading | Chain link | Yarn/Number of ends threaded |
|---|---|---|---|
| $G_1$ (front guide bar for chain stitch) | full-set | 01/10 | GF/1 |
| $G_2$ (guide bar for inlaid yarn) | full-set | 00/44 | GF/1 |

The resultant grey fabric was subjected to a soaping treatment in accordance with that in Example 1 to become a finished fabric which has a basis of weight of 32.0 g/m long×10 cm width, a course density of 15 courses/2.54 cm, a wale density of 14 wales/2.54 cm, and an elongation under a load of 300 g of 8.8% and an elastic recovery of elongation of 63.6%.

Comparative Example 2

A Raschel warp knit fabric was knit from polyester fiber yarns P (275 dtex/48 f) and spandex yarns S (154 dtex) by using a single Raschel warp knitting machine (12 gauge) having three guide bars ($G_1$, G2 and $G_3$) under the following knitting conditions.

| Guide bars | Threading | Chain link | Yarn/Number of ends threaded |
|---|---|---|---|
| $G_1$ (front guide bar for chain stitch) | full-set | 10/01 | P/2 |
| $G_2$ (middle guide bar for inlaid yarn) | full-set | 00/11 | S/1 |

-continued

| Guide bars | Threading | Chain link | Yarn/Number of ends threaded |
|---|---|---|---|
| $G_3$ (back guide bar for inlaid yarn) | full-set | 00/44 | P/2 |

The resultant grey Raschel warp knit fabric was subjected to a soaping treatment, in accordance with that in Example 3, to become a finished fabric which has a basis weight of 38.5 g/m×10 cm width, a course density of 22 courses/2.54 cm, a wale density of 12.2 wales/2.54 cm, and an elongation of 81.4% and an elastic recovery of elongation of 95.8%.

Use Example

Casting tapes of 10 cm wide were prepared from the stretch knit fabrics obtained by Examples and Comparative examples, and an ankle and a knee of a dummy was bandaged to compare the performance thereof as casting tapes.

The tapes of the Examples exhibited a uniform and large elongation in the longitudinal direction as a whole in comparison with that of Comparative example 1. Also, the former could easily bandage the target portion while conforming to irregular surfaces, and could be maintained there without slippage or deformation, whereby it was confirmed that it has a sufficient elastic recovery of elongation. In addition, there was a soft and elastic-looking appearance in the bandaged portion. On the contrary, the tape of Comparative example 1 was insufficient in elongation and stretchability, and required considerable skill for bandaging the aimed portion in conformity with its irregular configuration. Further, there was no soft and elastic-looking appearance in the bandaged portion.

While a tape obtained from Comparative example 2 in which spandex fibers are incorporated had a satisfactory elongation, the stretch-back property is too large to conform with small irregular surfaces in the aimed portion when bandaged, resulting in an inferior modeling property in comparison with the tape of Examples. As a result, the bandaged portion had a non-soft taut-looking surface. A stretch knit fabric obtained from Example 6 was formed solely of polyester fiber yarns wherein multifilamentary yarns are used in the ground fabric structure and monofilamentary yarns hardly causing creep are used as tuck warp. This fabric is a relatively thin fabric rich in stretchability without using thick yarns, and thus is suitable for a casting tape to be coated with resin having a high viscosity larger than approximately 10000 cps, for the purpose of suppressing the fluidity of the coated resin.

A casting tape prepared from the stretch knit fabric obtained from Example 6 and coated with water-curable polyurethane resin having a viscosity as high as 10000 cps exhibited good fitting in a test in which this casting tape is used for bandaging a heel, an arm and an elbow of a dummy, even if pleats or cuts are not provided in the tape. Also, it was confirmed that there was no problem in the strength of a cast after it was hardened.

FIG. 6 shows charts, of tensile elongations under load, of fabrics obtained in Example 1 and Comparative examples 1 and 2, during the stretching and shrinking cycle, from which it is apparent that the stretch knit fabric of the invention exhibits favorable elongation and stretch-back property because the stretch knit fabric of the invention has tuck loops of warp. Since the stretch-back property of the stretch knit fabric of the invention is not so significant as in the fabric containing spandex fibers obtained from Comparative example 2 having a large shrinkage energy but mainly caused by a gradual recovery of the deformation of the knit stitch, a tightening force is not applied to the affected part and also the elastic recovery of elongation is small after being bandaging. The above-mentioned use of the stretch knit fabric of the invention exhibits a performance in correspondence to the stretching characteristics typically shown by the shrinking curve of the inventive fabric.

EFFECTS OF THE INVENTION

Since the stretch fabric composed of the Raschel warp knit fabric of the invention is essentially free from elastomeric fiber material, the tightening force is gentle when covering or bandaging the affected part. The stretch knit fabric of the invention is suitable as a medical material for covering or bandaging an irregularly-shaped or curved portion of a human body or others at a proper tension or a fiber-reinforcement material for a molded object having bending or irregular surfaces. In the medical material field, it is suitably used as a stretchable bandage. Particularly, in the orthopedic field, it is favorably used as a fiber-reinforcement substrate such as a casting tape or a splint. In the article of stretch-bandaging, a wristband, a supporter, band for backache complainer, and the like.

What is claimed:

1. A stretch fabric material comprising a Raschel warp knit fabric formed of a hard fiber yarn in which loops of tuck warp are engaged with loops of a ground fabric structure, wherein the fabric has an elongation of at least 20% in the warp direction.

2. A stretch fabric material as defined by claim 1, wherein the ground fabric structure is selected from a group of a chain stitch, a dembigh-stitch and a queen's cord or a combination thereof.

3. A stretch fabric material as defined by claim 1, wherein the loop of the tuck warp is formed by a fall-plate.

4. A stretch fabric material as defined by claim 1, wherein the tuck warp is a synthetic fiber yarn having a size of at least 16.0 dtex.

5. A stretch fabric material as defined by claim 1, wherein the Raschel warp knit fabric is a double-sided fabric knit by a double-needle bar type Raschel warp knitting machine with a fall-plate.

6. A reinforced plastic-molded object having a substrate, the substrate comprising a stretch fabric material composed of a Raschel warp knit fabric formed of a hard fiber yarn in which loops of tuck warp are engaged with loops of a ground fabric structure, wherein the fabric has an elongation of at least 20% in the warp direction.

7. A stretch fabric material for a medical use composed of a Raschel warp knit fabric formed of a hard fiber yarn in which loops of tuck warp are engaged with loops of a ground fabric structure, wherein the fabric has an elongation of at least 20% in the warp direction.

8. A stretch fabric material for a medical use as defined by claim 7, wherein the tuck warp is a synthetic fiber monofilamentary yarn having a size of at least 55.0 dtex.

9. A bandage of a stretch fabric material for a medical use as defined by claim 7, wherein the tuck warp is a synthetic fiber monofilamentary yarn having a size of at least 55.0 dtex.

10. An orthopedic casting material formed of a stretch fabric material comprising a Raschel warp knit fabric formed of a hard fiber yarn in which loops of tuck warp are engaged with loops of a ground fabric structure, wherein the fabric has an elongation of at least 20% in the warp direction.

11. A stretchable body-bandaging material formed of a stretch fabric material according to claim 1 wherein a tuck yarn is a synthetic monofilamentary yarn having a size of at least 55.0 dtex or a composite yarn containing the monofilamentary yarn.

12. The stretch fabric material of claim 1, wherein the hard fiber yarn is selected from the group comprising of a natural fiber yarn, a synthetic fiber yarn and a glass fiber yarn.

13. The stretch fabric material of claim 1 wherein the elongation of at least 20% in the warp direction is under a load of 300a/10 cm width fabric.

14. The reinforced plastic-molded object of claim 6 wherein the elongation of at least 20% in the warp direction is under a load of 300a/10 cm width fabric.

15. The stretch fabric material for medical use of claim 7 wherein the elongation of at least 20% in the warp direction is under a load of 300a/10 cm width fabric.

16. The orthopedic casting material of claim 10 wherein the elongation of at least 20% in the warp direction is under a load of 300a/10 cm width fabric.

* * * * *